US005127757A

United States Patent [19]

Langer

[11] Patent Number: 5,127,757

[45] Date of Patent: Jul. 7, 1992

[54] CONNECTING HEAD FOR SCAFFOLD SYSTEM

[76] Inventor: Ruth Langer, Im Weinberg 13,D-7129, Gueglingen, Fed. Rep. of Germany

[21] Appl. No.: 599,855

[22] Filed: Oct. 19, 1990

[30] Foreign Application Priority Data

Oct. 19, 1989 [DE] Fed. Rep. of Germany ..... 3934857

[51] Int. Cl.[5] ..... F16B 7/00

[52] U.S. Cl. ..... 403/49; 403/190; 403/246; 403/272; 182/179

[58] Field of Search ..... 403/49, 191, 190, 246, 403/272, 271; 182/179, 178

[56] References Cited

U.S. PATENT DOCUMENTS

| | | | |
|---|---|---|---|
| 3,598,433 | 8/1971 | Savickas | 403/190 |
| 4,044,523 | 8/1977 | Layher | 403/49 X |
| 4,159,187 | 6/1979 | Cale | 403/272 |
| 4,595,077 | 6/1986 | Buttgereit | 403/49 X |
| 4,867,274 | 9/1989 | Langer | 403/49 X |
| 4,958,702 | 9/1990 | Langer | 403/49 X |

FOREIGN PATENT DOCUMENTS

| | | |
|---|---|---|
| 0276487 | 12/1987 | European Pat. Off. . |
| 2704398 | 8/1978 | Fed. Rep. of Germany . |
| 2449124 | 5/1979 | Fed. Rep. of Germany . |
| 3005128 | 8/1981 | Fed. Rep. of Germany . |
| 3121141 | 12/1982 | Fed. Rep. of Germany . |
| 3236648 | 4/1984 | Fed. Rep. of Germany . |
| 1362837 | 4/1964 | France . |

*Primary Examiner*—Peter M. Cuomo
*Attorney, Agent, or Firm*—Antonelli, Terry Stout & Kraus

[57] ABSTRACT

A connecting head for scaffold systems, with the connecting head including a connecting zone having centering lobes and an annular contact surface as well as a conical surface arranged so as to provide for favorable welding conditions.

11 Claims, 4 Drawing Sheets

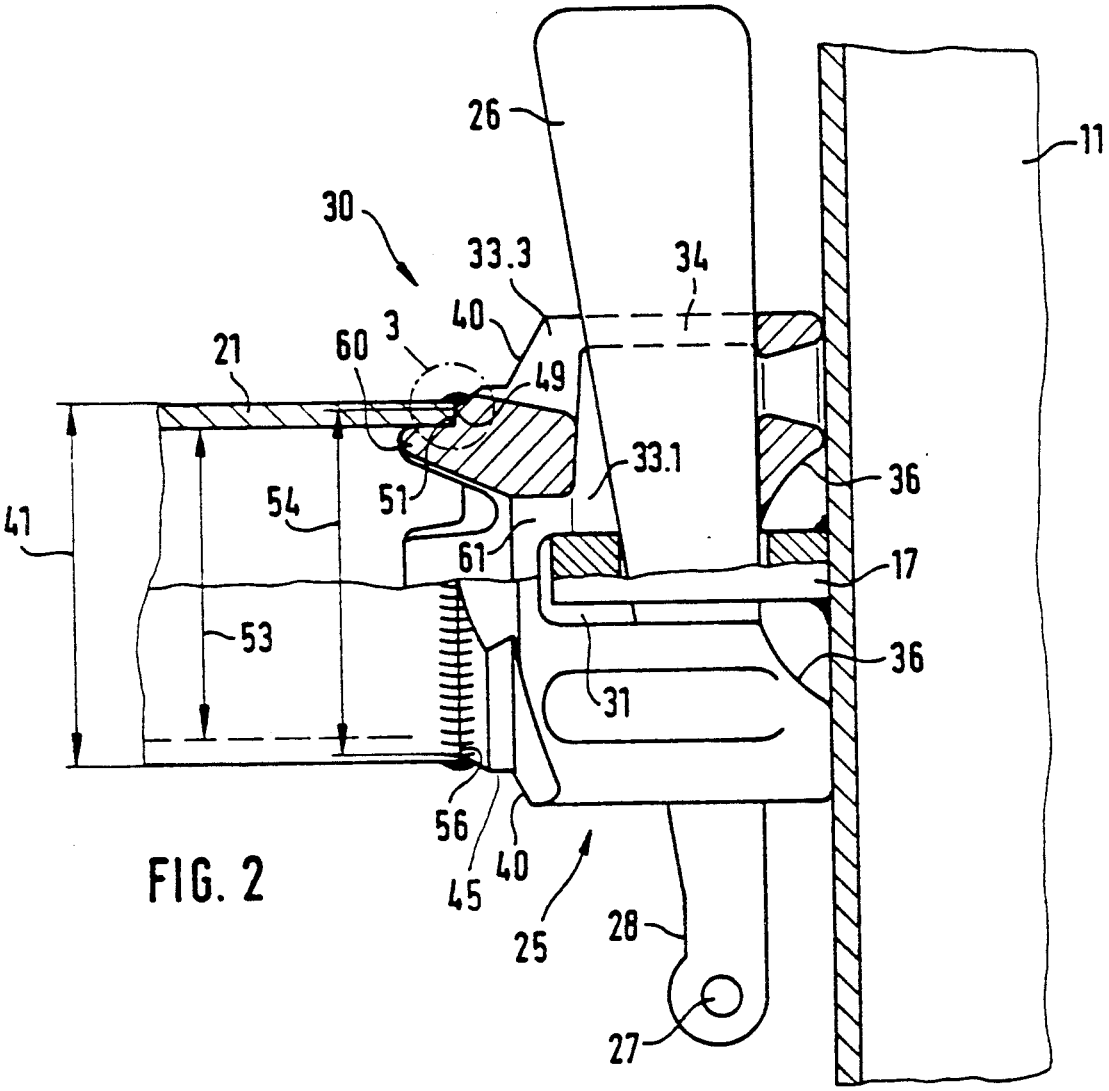
FIG. 2
FIG. 3
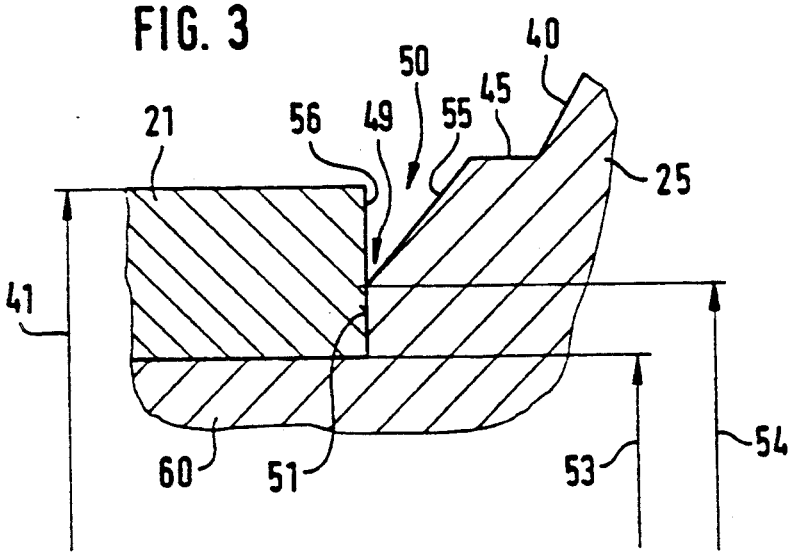

CONNECTING HEAD FOR SCAFFOLD SYSTEM

FIELD OF INVENTION:

The present invention relates to a scaffold system and, more particularly, to a connecting head for a scaffold system.

BACKGROUND OF THE INVENTION

Scaffold systems have been proposed utilizing vertical posts, with the vertical posts being arranged at a spacing corresponding to a grid of the scaffold system. Horizontally and/or diagonally extended elongated scaffold elements are generally attached to the annular connecting members with connecting heads, and vertical outer boundary surfaces of the connecting heads are fashioned so as to converge in a wedge shape toward the post and disc center. The connecting heads are generally fashioned of cast steel, malleable cast iron or forged steel, and the connecting heads mounted to the elongated scaffold elements are centered and welded in position.

Connecting devices of the aforementioned type are disclosed in, for example, German Pat. No. 2,449,124 and, from practical uses, by the Company Layher.-..Eibensbach. Normally the connecting heads are manufactured from malleable cast iron and exhibit, for centering within the pipe to which the connecting head is to be connected, at least three studs or centering lobes adapted to an inner diameter of the pipe of the scaffold system. A positioning surface at an end face, slightly projecting beyond an inner diameter and located normal on the pipe axis, is constructed so as to be continuous only in a zone of the inner diameter of the pipe. External portions of the positioning surface are interrupted in regions of the lateral, vertically extending surfaces which are slightly inclined rearwardly in a direction toward the pipe of the scaffold system.

A disadvantage of the above proposed connecting heads resides in the fact that the mounting is not provided with a seam bottom which extends continuously and uniformly all around but rather an L-shaped seam bottom results in part and an I-shaped seam must then be laid in the lateral zones. By virtue of this fact, and due to the properties on the material, irregularities arise during the circumferential welding by automatic welding machines, which irregularities adversely effect the connecting heads and/or overall scaffold system.

In, for example, DE No. 3,236,4678 A1, a building scaffold system is provided which includes cup-like connecting elements disposed on the scaffold posts and hook-equipped connecting heads are suspended in the cup-like connecting elements. The connecting heads are attached to the elongated scaffold elements by welding and, for this purpose, an extension is provided, with the extension being adapted to a free end of the horizontal span and suitably fastened by a weld seam. To enable an insertion, centering and attachment, a continuous conical surface is provided without special auxiliary alignment means, leading to a weld bond having a substantially V-shaped seam or a substantially L-shaped seam. The exact alignment with respect to the pipe during welding requires a corresponding aligning of the auxiliary means since there is no abutment face or annular contact surface.

DE No. 3,121,141 A1 also proposes a cup-shaped connecting head which, for engagement into an end of an elongated scaffolding element, includes a centering insert with rounded end construction, with the insert being placed into the pipe end. During this insertion step, the inner rim of the pipe end is seated with very little defined accuracy on rounded transition areas between the connecting head and the stud and a chamfer at the pipe permits a provision of a V-seam.

DE No. 2,704,398 A1 also proposes a connection arrangement for a scaffold system wherein a keyhole-like insert element with a scaffold pipe is constructed so that a shaped wedge member with a straight surface is placed in front of a straight cut-off face of the pipe and is welded in partial regions by V-shaped weld seams.

Additionally, DE No. 3,005,182 A1 proposes a connecting head with the above described features and including a conventional extension for attachment to a pipe of the scaffold system.

SUMMARY OF THE INVENTION

The aim underlying the present invention essentially resides in providing a connecting head for a scaffold system whereby a connection of the connecting head with a pipe of the scaffold system, with good centering and alignment conditions, results in the obtaining of more favorable automatic welding conditions.

In accordance with advantageous features of the present invention, the connecting device of the scaffold system includes a connecting head with an end of the connecting head on a side of the scaffold element including a structure or connection zone fitting to the scaffold element and suitable for welding. For this purpose, auxiliary fitting centering members are provided which extend into the scaffold element fashioned as a scaffold pipe. An annular contact surface is formed, with an outer diameter of the annular contact surface being smaller or less than the outer diameter of the scaffold pipe. The contact surface is followed, in a direction toward the outside thereof, by a forwardly flaring continuous conical surface.

By virtue of the fact that an annular contact surface is formed which continuously extends all around the connecting head and from an inner rim toward an outside thereof with the same ring width, which contact surfaces passes over, at an outer diameter, into a forwardly flaring partial-cone surface, i.e., a conical surface, a continuous groove bottom is obtained having the shape of one half of a V-shaped seam.

With the above described arrangement of the present invention, the pipe edge can be uniformly consumed by melting during a melting step while an adjoining wall of the malleable cast iron offers almost uniform substrate conditions at all locations thereby leading to a uniform burn out, a uniform seam pattern, and thus a high-strength weld bond which is uniform in all directions in accordance with the selected material conditions.

Yet another advantage of the present invention resides in the conical surface passing over in the substantially vertical lateral marginal zone with an almost continuous transition into the wedge-shaped surface portions extending on the same outer radius and with approximately the same inclination.

Advantageously, the cylindrical surface follows the conical surface, with a diameter of the cylindrical surface being equal to or slightly greater than an outer diameter of the pipe of the scaffold system and passing over in the vertical marginal zones into the wedge-shaped surface portions. By virtue of the last arrangement, the welding conditions are improved in the frame structurally predetermined by the modular system.

In accordance with further advantageous features of the present invention, the connecting head is provided, in portions projecting beyond an outer diameter of the pipe of the scaffold system, with a rearward terminal surface or side fashioned of forwardly inclined partial spherical surfaces which rise from the partial spherical surface adjoining the cylindrical portion in the connecting zone.

By virtue of the last noted feature of the present invention, the amount of material required for the flow of force resulting from stress is arranged at favorable locations and vacant spaces for enabling a complete or all around welding operation are adequately provided without impairment of the stability of the connecting head. Furthermore, a lower expenditure in material and more favorable positioning conditions exist for parts of the welding equipment.

In accordance with still further features of the present invention, in a scaffold system with vertical posts, annular perforated discs are attached to the vertical posts at a spacing corresponding to a grid of the scaffold system. Horizontally and/or diagonally extending elongated scaffold elements are attached to the annular perforated discs with the connecting heads. Advantageously, the connecting heads engage over the perforated discs with slots, and the connecting heads have wedge openings lying perpendicularly one above the other for wedges extending through the wedge openings and the disc holes or slots. Vertical outer boundary surfaces of the heads are fashioned so as to converge in a wedge shape toward the post and center of the disc, and contact supporting surfaces of the connecting heads have a height larger than a diameter or height of the elongated scaffold elements. The connecting heads are advantageously fashioned of cast steel, malleable cast iron or forged steel, and connecting heads attached to the elongated scaffold elements are centered by extensions engaging into a profile of the scaffold elements and welded in place.

Advantageously, according to the present invention, the connecting heads decrease, from the outer boundaries of the contact supports, gradually to the outer diameters and/or heights of the elongated scaffold element. An end of the scaffold pipe side exhibits a fitting configuration of a connecting zone suitable for welding and, for this purpose, inwardly projecting centering lobes fitting into the pipe are provided. An annular contact surface is formed having an outer diameter which is less than an outer diameter of the pipe of the scaffold system and, adjoining thereto is a forwardly flaring conical surface which follows toward the outside. The conical surface passes over, in the vertical marginal regions of the connecting head into approximately equally inclined wedge surface portions. A cylindrical surface adjoins the conical surface, with a diameter of the cylindrical surface being equal to or slightly greater than an outer diameter of the pipe of the scaffold system. The cylindrical surface passes over, in the vertical marginal zones, into the wedge surfaces The subject matter of the present invention is suitable not only for constructions described hereinabove, but for similar connecting heads with associated elements where similar problems are encountered.

The above and other objects, features and advantages of the present invention will become more apparent from the following description when taken in connection with the accompanying drawings which show, for the purpose of illustration only, one embodiment in accordance with the present invention.

BRIEF DESCRIPTION OF THE DRAWINGS

FIG. 2 is a partial vertical cross section and partial lateral view of a connecting joint with a connecting head and regions surrounding the connecting head;

FIG. 3 is an enlarged cross-sectional view of a zone designated by the reference numeral 3 in FIG. 2 in a condition prior to a welding operation;

DETAILED DESCRIPTION

Figure 1:
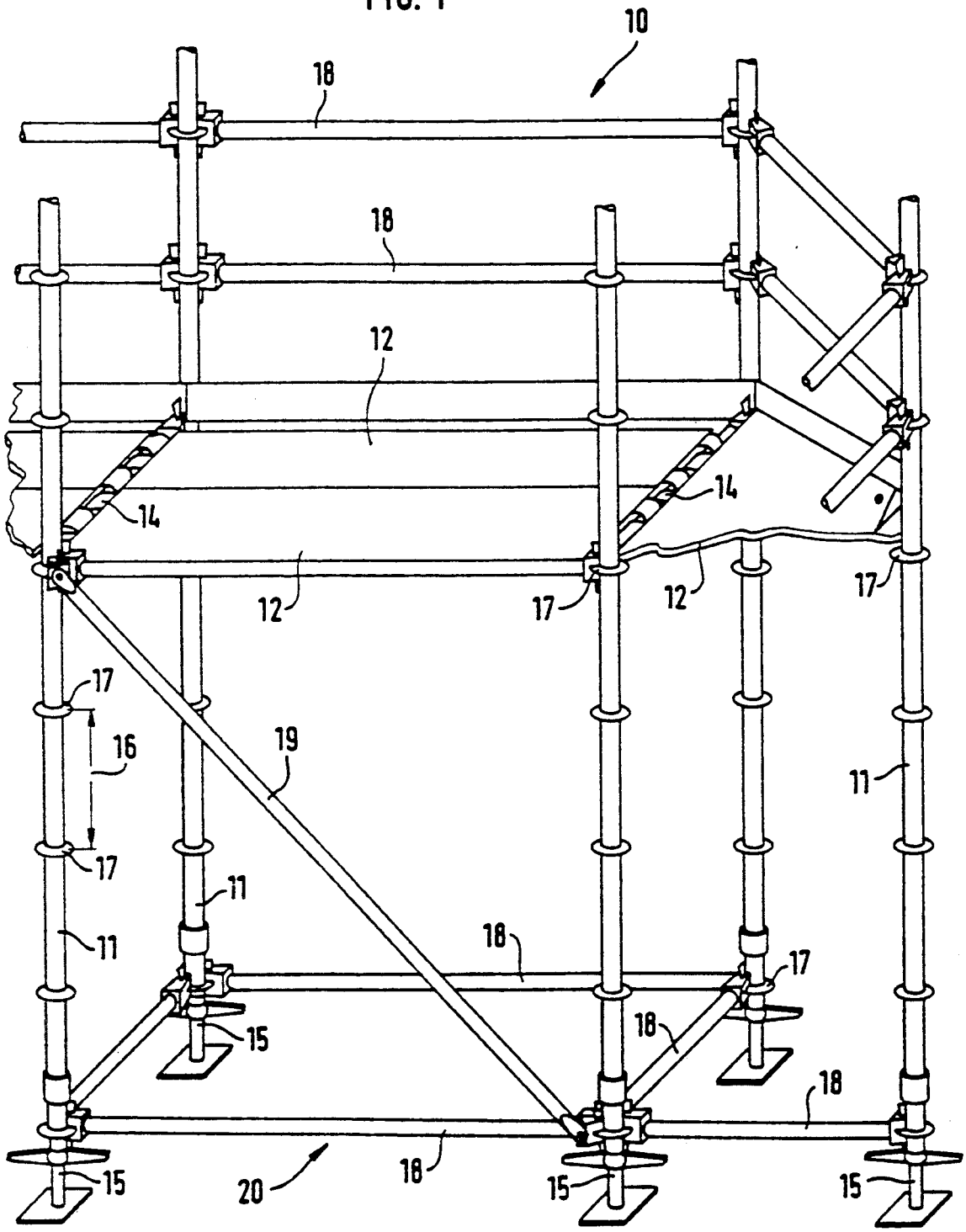
FIG. 1 is a schematic oblique view of a portion of a scaffold system employing connecting heads constructed in accordance with the present invention.
Figure 4:
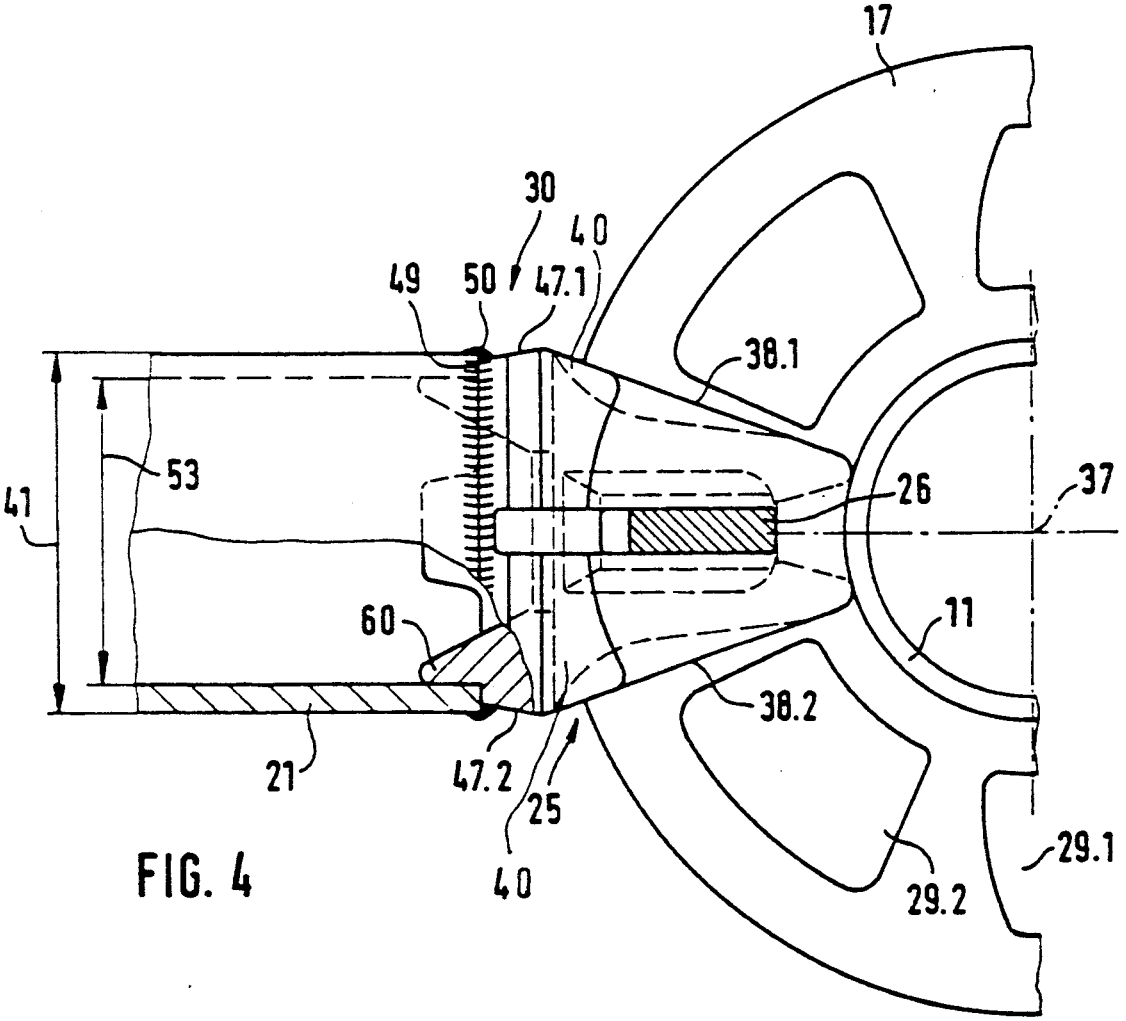
FIG. 4 is a partial cross-sectional view of a connecting joint with a perforated disc wherein only one connecting head with adjoining scaffold pipe region and portions of a perforated disc are illustrated partially in cross-sectional view and partially in top view.

Referring now to the drawings wherein like reference numerals are used throughout the various views to designate like parts and, more particularly, to FIG. 1, according to this figure, a scaffold system generally designated by the reference numeral 12 includes a plurality of vertically extending posts 11 and scaffold platforms 12 suspended, in a conventional manner, by suspension claws accommodated in horizontally disposed supporting spans 14. The vertical posts 11 are supported on a ground or support surface by conventional height adjustable support feet 15. Connecting elements fashioned, for example, as perforated discs 17 are attached to the posts 11 at a spacing 16 corresponding to a basic scaffold grid dimension system. As shown in FIG. 4, the perforated discs 17 may be provided with a plurality of different sized holes such as, for example, smaller holes 29.1 for accommodating scaffold elements generally designated by the reference numeral 20 adjoining each other at a right angle such as, for example, horizontal bars 18 and supporting spans 14. Larger holes 29.2 may be provided for accommodating diagonally adjoining scaffold elements 20 such as, for example, diagonal rods 19. The scaffold elements 20 are generally horizontal bars 18 and diagonal rods 19 and may have differing lengths depending on a particular use of the scaffold system. The horizontal bars 18 may also, as shown most clearly in FIG. 1, be used as railings.

As shown in FIGS. 2–4, the scaffold elements 20 may also be formed with cylindrical scaffold pipes 21 to which connecting heads generally designated by the reference numeral 25 are welded. Conventional wedges 26 (FIGS. 2 and 4) extend through corresponding wedge-shaped openings and are generally hammered or forced in place. The wedges 26 are provided, at a lower end thereof, with a penetrating pin or rivet 27 which functions as a securing means against a loosening or inadvertent displacement of the respective wedges. Each of the wedges 26 include a lateral recess 28 which is shaped such that the wedge 26 can be placed, in an uprightly drawn position, in parallel to the scaffold pipe 21. Each connecting head 25 has a connection zone generally designated by the reference numeral 30, a perforated disk slot 31 and contact surfaces 32 by which the connecting head 25 rests on the post 11 when it has been passed, with the perforated disk slot 31, over a perforated disk 17 in a conventional manner. The connecting head 25, as shown most clearly in FIG. 5, includes wedge openings 33.1 and 33.2 lying vertically one above the other, with the wedge 26 being adapted to be passed through the openings 33.1, 33.2. The upper wedge opening 33.1 is constructed in a marginal zone with an inwardly projecting contact bead 34 for an abutment of the rivet 27 serving as the security or retaining means. The wedge opening 33.1 is conventionally open in a rearward pivoting region 33.3 so that the wedge 26 can be pivoted rearwardly once the heads of the rivet 27 rest on oppositely located contact beads 34.

The wedge openings 33.1, 33.2 have a width sufficient for the heads of the rivet 27 to be conveniently passed therethrough. In order to improve the placement of the connecting head 25 on the perforated disc 17, the perforated disc slot 31 includes rounded inserted corners 36 (FIGS. 2 and 5) of a conventional configuration.

As shown most clearly in FIG. 4, the entire connecting head 25 is fashioned so as to converge in a wedge shape toward the inside to the post and disc center 37, with the outer boundary surfaces 38.1 and 38.2 being constructed so as to be planar in the marginal contours of their outwardly projecting beads, as has also been customary in the case of conventional connecting heads. With such an arrangement it is also possible to connect diagonally extending bars and to place the connecting heads thereof maximally close against the outer boundary surface of the connecting heads of the bars extending at a right angle to each other. The outer boundary surfaces 38.1 and 38.2, in order to minimize weight, include depressions 39.1, 39.2 between their beads, with the depressions 39.1, 39.2 being constructed substantially in a conventional manner.

Figure 5:
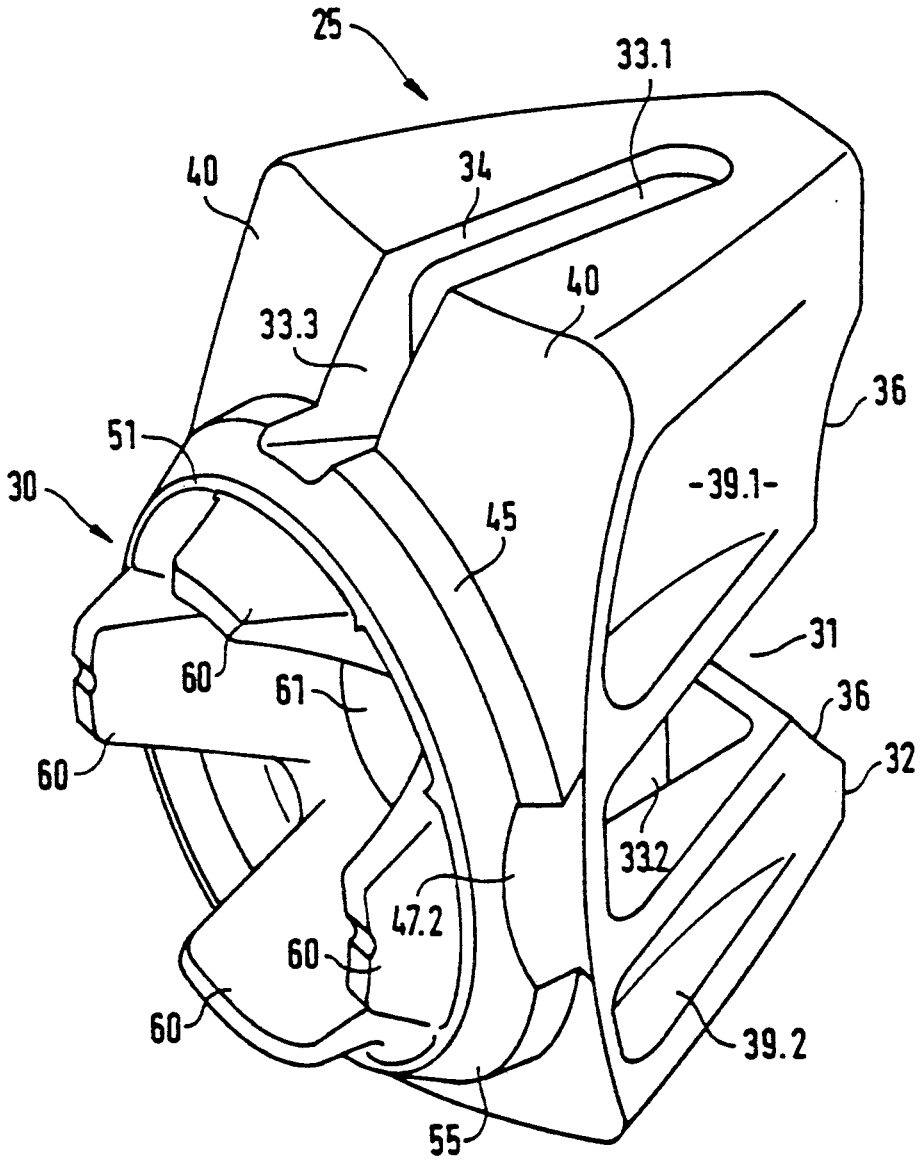
FIG. 5 is an oblique view of a connecting head constructed in accordance with the present invention.

A rearward terminal surface 40 of the solid material zones of the forward connecting head 25 is, in accordance with the present invention, fashioned so as not to be planar but rather as an outwardly inclined surface as shown most clearly in FIGS. 2 and 5. Advantageously, the shape is partially spherical and, as a result, with unchanged rigidity or ruggedness of the entire connecting head 25, the welding devices which, for fastening purposes, are to be guided around the connecting zone can be more liberally handled and can have a more suitable structure in order to attain an improved welding connection in the connecting zone 30.

The boundary surface portions of the boundary surface 40, fashioned as partial spherical surfaces, rise from partial cylindrical surfaces 45 having approximately an outer diameter 41 of the pipe 21. The upper partial cylindrical surface 45 is chamfered only in an upper region in a center quite somewhat by a rearward pivoting zone 33.3 of the upper wedge opening 33.1. The upper and lower cylindrical partial surfaces pass over, in the vertical marginal zones directly adjoining the outer boundary surfaces 38.1 and 38.2, into oblique surfaces 47.1, 47.2, as shown most clearly in FIG. 5. The inclined surfaces 47.1 and 47.2 extend approximately to the groove bottom 49 of the weld seam generally designated by the reference numeral 50 (FIG. 3).

As shown in FIG. 3, a groove bottom generally designated by the reference numeral 49 is delimited by an annular contact surface 51 extending throughout the entire welding region. The annular contact surface 51 has a circle as an inner boundary thereof, with the circle being approximately as large as an inner diameter 53 of the scaffold pipe 21. An outer diameter 54 of the annular contact surface 51 is selected so as to result in the formation of a favorable V-seam weld bond. A forwardly flaring conical surface 55 adjoins the annular contact surface 51, with the conical surface 55, together with the linearly cut-off end face 56 of the scaffold pipe 21, defining a half of a V-seam for welding. The conical surface 55 passes over only with a quite minor interruption into the lateral inclined surfaces 47.1, 47.2 in a practically continuous fashion so that no discontinuity of material flow results during the continuous introduction of the weld seam. By virtue of a combination of the above noted structural features, it is ensured that it is possible for an exchangability in a modular system to maintain previously customary dimensions of the connecting heads and yet achieve a better weld bond.

For centering purposes during attachment of the connecting head 25 onto the scaffold pipe 21, as shown in FIGS. 2–5, inwardly projecting centering lobes 60 are provided which fit into the scaffold pipe 21. An outer boundary of the centering lobes 60 corresponds to an inner diameter 53 of the scaffold pipe 21 and the centering lobes 60 pass over, with a bevel, into an inner opening 61. The centering lobes 60 have a width which, advantageously, amounts to somewhat less than ⅛ of a circumference of the scaffold pipe. The size of the centering lobes 60 depends upon the design possibilities or criteria and the tolerable weight taking into account that the centering lobes 60 are adequately rugged during mounting and welding and do not constitute an impediment. The centering lobes may be similarly configured to conventional lobe arrangements.

By virtue of the provision of the connecting zone 30 with an annular contact surface 51 and with the adjoining conical surface 55 as well as the incorporation of the other expedient surface forms of the present invention, substantially improved welding conditions are obtained which substantially promote the safety of the bond for the structural components and therefore contribute significantly toward a total safety of the scaffolds. Identical connecting heads may be utilized, with appropriate devices, on a short scaffold pipe section also for connection of diagonal rods and for other auxiliary devices by imparting to the scaffold pipe section a appropriate configuration.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A connecting head for enabling a connection of elongated scaffolding elements to connecting members of a scaffold system, the connecting head comprising a connection zone on a side thereof adjoining an end of the respective scaffolding element to be connected to the connecting members for enabling the connecting head to be welded to the respective scaffolding elements, said connecting zone including auxiliary centering means provided on said connection head and adapted to extend into the respective scaffold elements, an annular contact surface abutting an annular end face of said respective scaffolding element and having an outer diameter less than an outer diameter of said end face of the respective scaffold element, a forwardly-flaring continuous conical surface contiguous with the annular contact surface and extending toward an outer surface of the connecting head having an outer diameter greater than said outer diameter of said end face of said respective scaffold element, and wherein the conical surface passes over in substantially vertical marginal regions of the connecting head into said outer surface and approximately equally inclined lateral surface portions in a substantially continuous fashion whereby no discontinuity of material flow results during a formation of weld seam.

2. A connecting head according to claim 1, wherein the connecting members include annular disk-shaped member attached to spaced vertical posts of the scaffold system, said connecting members being spaced on the respective vertical posts at a spacing corresponding to a grid of the scaffold system, and wherein the connecting heads include vertical outer boundary surfaces converging in a wedge shape toward the respective scaffold elements and a center of the respective annular disk-shaped members.

3. A connecting head according to claim 2, wherein the scaffold elements include horizontally and/or diagonally extending scaffold pipes.

4. A connecting head according to claim 3, wherein the connecting head is fashioned of one of a cast steel, malleable cast iron and forged steel.

5. A connecting head according to claim 1, wherein the connecting head further includes a rearward terminal surface fashioned of forwardly inclined partial spherical surfaces which rise from said cylindrical surface adjoining said conical surface, said rearward terminal surface projecting beyond an outer diameter of the respective scaffold pipes.

6. A connecting head according to claim 1, wherein the connecting head is fashioned of one of a cast steel, malleable cast iron and forged steel.

7. A connecting head according to claim 1, wherein the connecting members include annular perforated disks attached to vertically spaced posts of the scaffold system, the annular perforated disks being spaced on the respective vertical posts at a spacing corresponding to a grid of the scaffold system, and wherein the connecting head includes slot means adapted to engage over the respective annular perforated disks.

8. A connecting head according to claim 7, wherein the connecting head further includes a pair of wedge openings lying perpendicularly one above the other for accommodating retaining wedges extending through the wedge openings and perforations in the respective perforated disks.

9. A connecting head according to claim 8, wherein the connecting head further includes contact support surfaces having a height greater than a diameter of the respective elongated scaffold elements.

10. A connecting head according to claim 9, wherein the connecting heads decrease from outer boundaries of the contact surfaces gradually to at least one of an outer diameter and height of the respective elongated scaffold elements.

11. A connecting head according to claim 10, wherein the connecting head is fashioned of one of a cast steel, malleable cast iron and forged steel.

* * * * *